United States Patent [19]

Roch

[11] Patent Number: 4,494,312

[45] Date of Patent: Jan. 22, 1985

[54] PRESS BRAKE GAUGING APPARATUS

[75] Inventor: Gerald V. Roch, Indianapolis, Ind.

[73] Assignee: Hurco Manufacturing Co., Inc., Indianapolis, Ind.

[21] Appl. No.: 415,429

[22] Filed: Sep. 7, 1982

[51] Int. Cl.[3] ..... B21D 11/22

[52] U.S. Cl. ..... 33/170; 72/36; 72/461

[58] Field of Search ..... 33/162, 169 R, 170, 33/181 R, 185 R; 72/36, 461

[56] References Cited

U.S. PATENT DOCUMENTS

| | | | |
|---|---|---|---|
| 3,221,411 | 12/1965 | Bickford | 33/171 |
| 3,260,087 | 7/1966 | Guarino | 72/36 |
| 3,618,349 | 11/1971 | Roch | 72/36 |
| 3,666,227 | 5/1972 | Frederick | 33/170 |
| 3,704,611 | 12/1972 | Hirsch | 72/36 |
| 3,812,695 | 5/1974 | Roch | 72/461 |
| 3,820,377 | 6/1974 | Roch | 72/461 |
| 3,826,119 | 7/1974 | Marotto | 72/461 |
| 3,874,205 | 4/1975 | Roch et al. | 72/461 |
| 4,055,070 | 10/1977 | Wingate et al. | 72/461 |
| 4,084,424 | 4/1978 | Roch et al. | 72/461 |
| 4,411,150 | 10/1983 | Klein et al. | 72/461 |

FOREIGN PATENT DOCUMENTS

| | | | |
|---|---|---|---|
| 2318152 | 10/1973 | Fed. Rep. of Germany . | |
| 2317882 | 10/1973 | Fed. Rep. of Germany | 72/461 |
| 121507 | 12/1918 | United Kingdom | 33/170 |
| 567373 | 2/1945 | United Kingdom | 33/162 |

*Primary Examiner*—Richard R. Stearns

*Attorney, Agent, or Firm*—Woodard, Weikart, Emhardt & Naughton

[57] ABSTRACT

A gauge bar assembly is provided with T-nut, quick-action hand clamp brackets to linear bearing blocks of a gauge drive mechanism. Gauge mounting brackets are supported and guided on upstanding tubes in the quick-action clamp brackets. Powered vertical drive for the mounting brackets is provided. A gauge bar having unusually high resistance to bending, due to a unique Y-shaped cross section, is clamped to the gauge mounting brackets. Flip fingers with manually adjustable adjustment wedges, and spring take-up means, are provided for precise horizontal adjustment of gauging fingers toward and away from press brake tooling.

18 Claims, 11 Drawing Figures

PRESS BRAKE GAUGING APPARATUS

BACKGROUND OF THE INVENTION

1. Field of the Invention

This invention relates generally to presses, and more particularly to back gauges for press brakes.

2. Description of the Prior Art

Powered back gauges for press brakes have become well known and widely used. Various gauges and drives and workpiece locating features are shown in U.S. Pat. Nos. 3,618,349 issued Nov. 9, 1971, 3,812,695 issued May 28, 1974, 3,820,377 issued June 28, 1974, 3,874,205 issued Apr. 1, 1975, and 4,084,424 issued Apr. 18, 1978. These patents show various ways of mounting and driving gauge bars and fingers. U.S. Pat. No. 3,812,695 shows a tilting gauge bar arrangement, and also pivoting gauge fingers which have come to be known as "flip fingers". These accommodate upward movement of the workpiece, even though it may have a flange which would otherwise interfere with the fingers upon bending the workpiece.

In order to accommodate the length (or width) of workpiece a press brake can handle, the gauge bar should be furnished of a length compatible witn the size of the press brake. In some larger sizes a gauge bar can be fairly long and heavy. Efforts to reduce weight can reduce strength and result in bending. The vertical position of the face of a bowed gauge bar will determine how much of it is useful as a workpiece locator, or as a mount for fingers. The above patents disclose various means of gauge bar height adjustment. There remains a need for greater ease of precise adjustment to establish desired bar and locating finger height and distance with respect to the bending dies in a press brake. There is also a need for greater precision in finger height and length location particularly in press brakes having long gauge bars. The present invention is addressed to meeting those needs.

SUMMARY OF THE INVENTION

Described briefly in a typical embodiment of the present invention, a gauge bar is provided with a cross sectional shape having substantial resistance to bending in either a horizontal or vertical direction and yet of relatively modest weight. The shape facilitates attachment to a pair of mounting means vertically slidable on columns secured to bearing blocks driven by power positioning means for the gauge. Powered vertical drive for the mounting means is provided to raise and lower the gauge bar. Vertically pivotable gauge fingers are mounted to the gauge bar and precisely manually adjustable toward and away from the forming dies of the press brake, for initial adjustment.

DESCRIPTION OF THE PREFERRED EMBODIMENT

Figure 1:
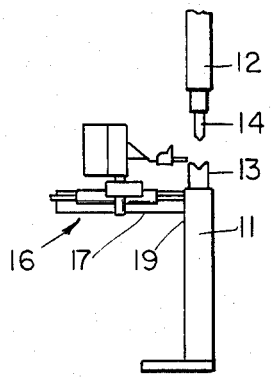
FIG. 1 is a schematic side elevational view of a portion of a press brake, with gauging apparatus thereon according to a typical embodiment of the present invention.
Figure 4:
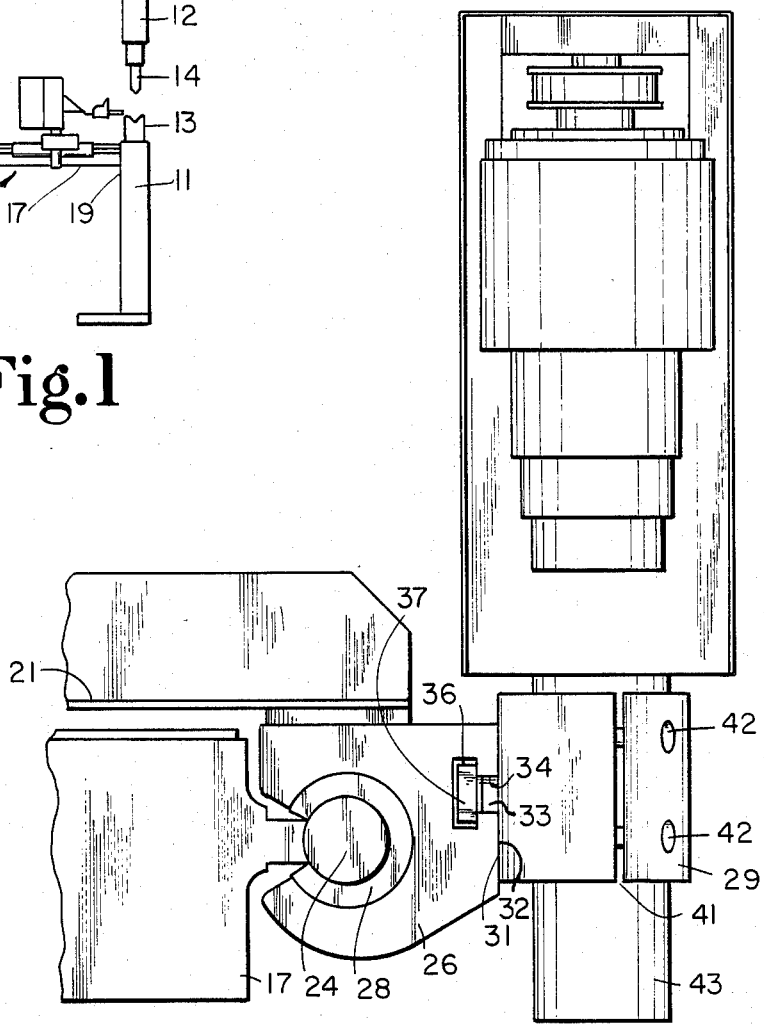
FIG. 4 is a fragmentary rear elevational view of the gauging apparatus.
Figure 2:
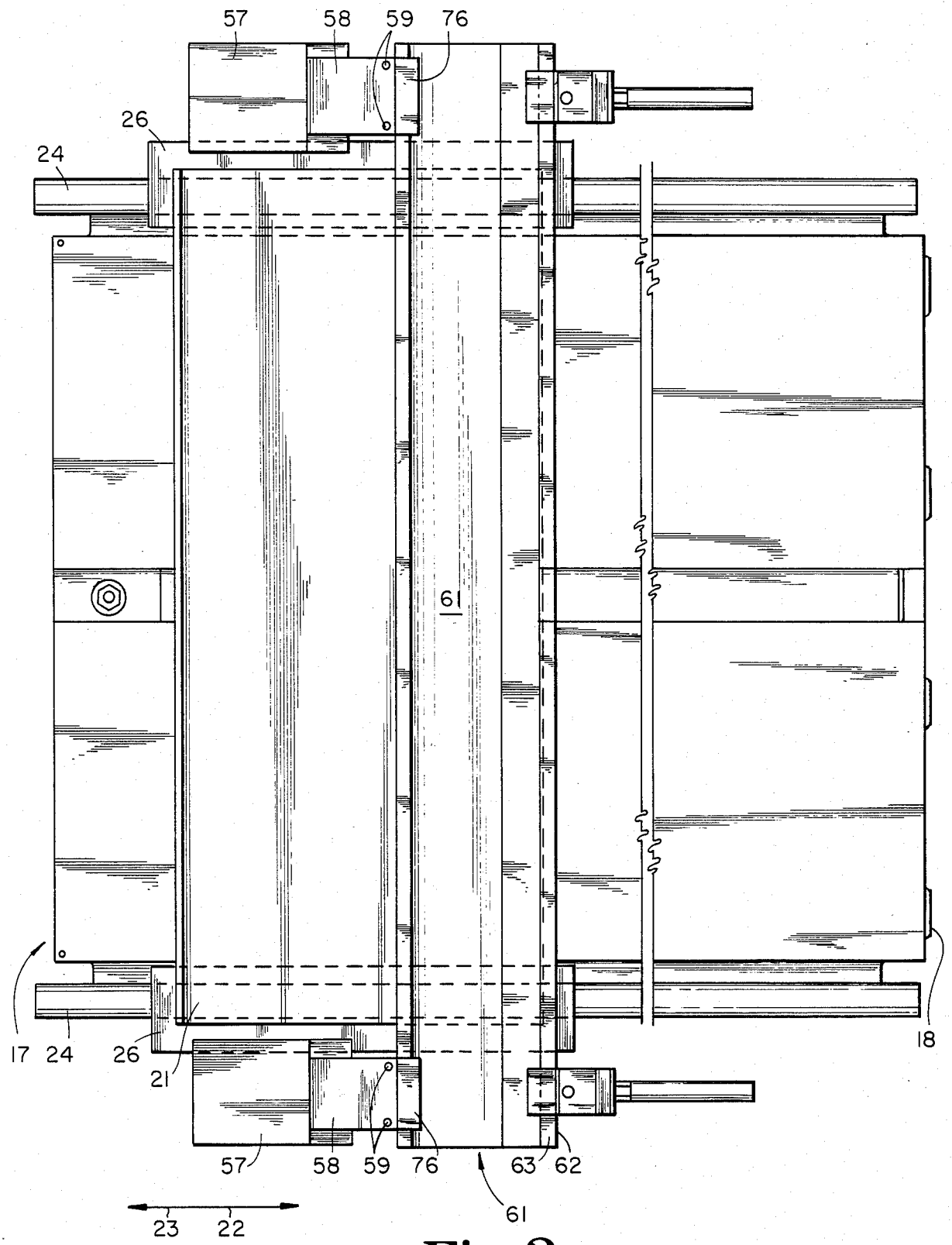
FIG. 2 is a much enlarged top plan view of the gauging apparatus.

Referring now to the drawings in detail, and particularly FIG. 1, there is shown fragmentarily, a press brake having a bed 11, a vertically movable ram 12 with appropriate dies 13 and 14 secured respectively to the bed and ram. Back gauge apparatus 16 is secured to the rear face of the bed 11. It includes a main frame and drive housing assembly 17 having pads 18 (FIG. 2) at the front end with apertures therein to receive fasteners for attaching it to the rear face 19 of the press brake bed 11 in a manner which is known in the art. The assembly includes a servomotor drive with encoder and connector means to a saddle 21 whereby the saddle can be driven in the direction of arrow 22 toward the press brake dies or in the direction of arrow 23 away from the press brake dies. To maintain alignment of the saddle during the operation thereof, guide rods 24 are secured to opposite sides of the housing 17. They receive front and rear ball guide bushings which are secured in extruded aluminum bearing blocks 26 which are secured to the saddle with threaded fasteners. The well known "Thomson" rods and bushings 28 (FIG. 4) are suitable for this purpose.

Figure 5:
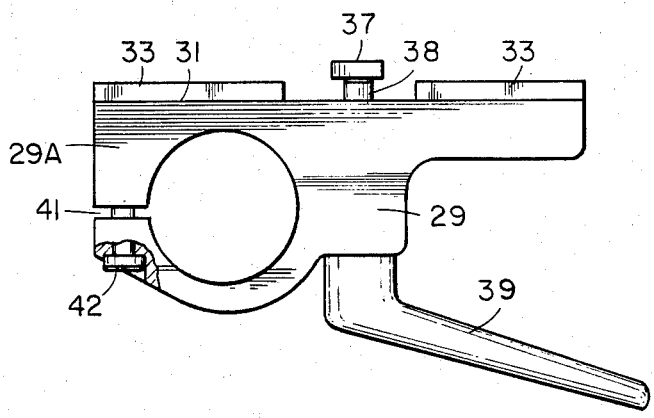
FIG. 5 is a top plan view of the mount clamp bracket assembly.

According to one feature of this invention, a new mount for a gauge bar is provided. This includes a pair of brackets 29. Each has a flat inner face 31 (FIGS. 4 and 5) secured to the flat face 32 of a bearing block 26. It is properly aligned by the bearing block by means of a pair of longitudinally extending ribs or keys 33 which are an integral part of the bracket casting and are received in portion 34 of the T-slot 36 which extends the length of the bearing block and is parallel with the axis of the ball bushings 28 therein. A T-nut 37 at the end of a stud 38 is received in the head of the T-slot. A clamp handle 39 is threaded onto the other end of the stud. A quarter turn of the handle is sufficient to pull the T-nut against the wall of the T-slot and clamp the bracket 29 tight against the bearing block, or release it.

The bracket 29 is split at 41. Two screws 42 are threaded into the portion 29A of the bracket inboard of the split. These screws, when tightened, clamp the bracket onto a guide column or tube 43, which is otherwise vertically slidably received in the bracket. The tubes can be fairly long, if the machine bed-to-die height is unusually great, to support the gauge bar at an elevation well above that of housing 17.

A gauge bar mounting bracket 44 is a generally cylindrical casting having an internal cylindrical wall at 46 slidingly received on the column 43. A nut 47 is affixed in the tube 43 near the upper end. It receives therein the vertical adjusting screw 48, which may have ten threads per inch, for example. This screw is supported radially and axially by a ball bearing assembly 49 secured in the upper end of the bracket 44. A pulley 51 is secured to the upper end of the screw 48. A vertical servomotor-encoder assembly 52 is secured to a bracket 53 secured to the bracket 48. This motor has a drive pulley 54 on its output. A gear belt 56 provides the drive between the pulley 54 and 51. Accordingly, upon operation of the motor in either direction, the bracket 44 can be driven up or down within the limit of the length of the drive screw 48. It is shown in the fully down position in the drawings. The provision of an encoder on the motor enables digital determination of the height of the assembly with respect to some reference point which can be directly related to the height of the fingers with respect to the stationary die of the press brake.

Since the present invention is usable also with handwheel operated vertical adjustment, rather than powered adjustment, the motor and belt housing 57 is simply a rectangular open-bottom shell secured to a mounting block 58 which can be fastened by screws 59 to the top of the bracket 44.

Figures 3, 6, 7, 8, 9, 10, 11:
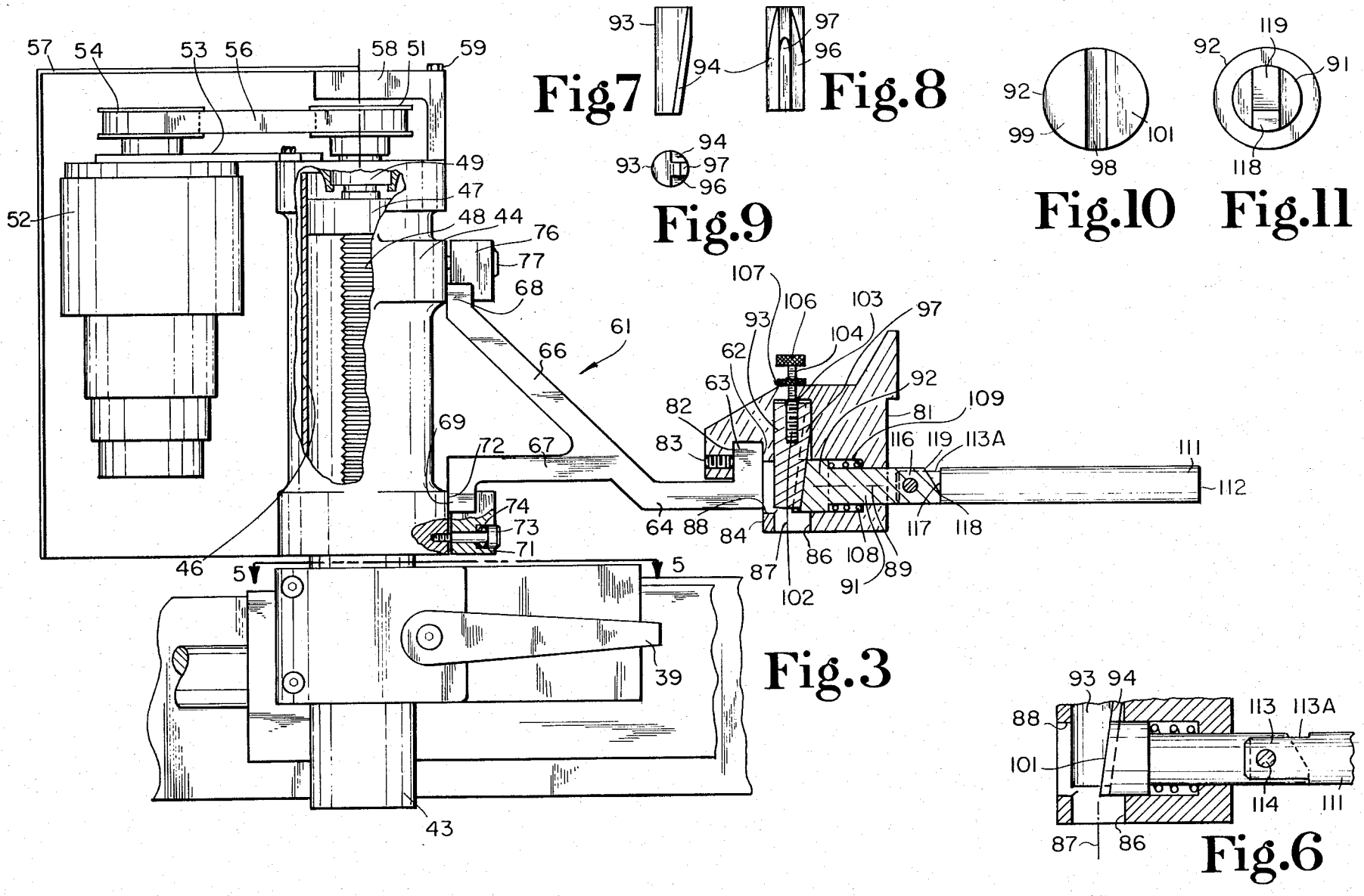
FIG. 3 is a still further enlarged side elevational view of the gauging apparatus with portions in section to show interior details.
FIG. 6 is an enlarged fragmentary side sectional view of a portion of the finger mounting bracket and finger assembly.
FIG. 7 is a side elevational view of an adjusting wedge.
FIG. 8 is a front elevational view of the adjusting wedge.
FIG. 9 is a bottom plan view of the adjusting wedge.
FIG. 10 is a rear end view of the finger support plunger.
FIG. 11 is a front end view of the finger support plunger.

According to another feature of the present invention, a gauge bar 61 is provided with a very unusual cross sectional shape. As shown in FIG. 3, the gauge bar has the appearance of a Y lying on its side. This gauge bar is an aluminum extrusion. It includes a workpiece locating face 62, part of which is the front of the upstanding front flange 63. The "stem" 64 of the Y extends to the rear and slightly upward, where it branches to the upper arm 66 and the lower arm 67. The upper arm has an upturned vertical flange 68 at the upper end thereof, while the lower arm has a downturned vertical flange 69 at the end thereof.

An L-shaped clamp 71 clamps the flange 69 to the flat front face 72 of bracket 44. For this purpose, a shoulder screw 73 is used and threaded into the bracket 44 until it stops. One or more Belleville spring washers 74 are mounted between the head of this screw and a seat surface in the clamp 71 to adequately load the clamp against the flange 69 when the screw shoulder has seated on the bracket 44. Likewise, clamp 76 secured by screw 77 clamps the upper flange 68 of the gauge bar to the bracket 44. The substantial vertical height between the upper and lower mounting flanges 68 and 69 of the gauge bar, together with the effect of the arm 66 as a structural web resisting deflection up or down throughout the length of the gauge bar, prevents sagging of the gauge bar even though it may be over nine feet long, the typical length for a heavy duty gauge bar being nine feet six inches. This is true even though the horizontal spacing between the upper clamps 76 might be 34 inches or 40 inches, depending upon the width of the gauge drive housing, guide rod spacing and related parts. For a gauge bar that is nine feet six inches long, for example, the distance between the plane of the clamping flanges of the gauge bar and the gauging face of the gauge bar is approximately 6 inches. The vertical distance between the upper and lower arms at the clamping flanges thereof is approximately 4.5 inches.

According to another feature of the invention, pivoting fingers are provided with independent adjustment. For this purpose, a finger mounting bracket 81 is provided. It has a downwardly opening slot 82 at the rear, fittingly and slidably received on the front flange 63 of the gauge bar. The top of the slot rests on the top of the gauge bar flange. The position of the bracket along the length of the gauge bar can be secured by a set screw 83 threadedly received in the bracket body and engaging the rear of the gauge bar flange. The rear face 84 of the bracket is flat and is flush with the front face 62 of the gauge bar to securely locate the bracket 81 on the gauge bar. The bracket has a cylindrical aperture 86 having an axis 87 which is vertical and parallel to the rear face 84. It also has a horizontal cylindrical aperture 88 having an axis 89 intersecting the axis 87.

A finger support plunger 91 has a cylindrical head 92 slidably received in the aperture 88 in front of the aperture 86. A wedge plunger 93 has a substantially cylindrical body received in the cylindrical bore 86. As best shown in FIGS. 7 through 9, plunger 93 has two ramp faces 94 and 96 which are co-planar and on opposite sides of a tongue or rib 97. These faces are at an angle of 7° with respect to the longitudinal axis of the plunger. In the assembly, this axis is co-linear with the axis 87 of the aperture 86. The finger support plunger head 92 has a groove 98 therein slidably receiving the tongue 97 of the wedge. The head faces on opposite sides of the groove at 99 and 101 are flat and at an 83° angle with respect to the axis of the plunger. Therefore, they are flush with the faces 94 and 96 of the plunger 93 in the assembly. Accordingly, the plunger 93 can serve as a wedge and, with the ramps 94 and 96 at the 7° angle, it is a self-locking wedge. Other angles and vertical adjustment means may be used to achieve precise horizontal adjustment of gauge finger. In this way, an axial force directed by the finger support plunger against the wedge is incapable of moving the wedge upward in the bracket 81. The self-locking angle is desirable but not mandatory.

The wedge is internally threaded ($\frac{1}{4}$–20 thread being typical) and receives the wedge adjusting screw thread 102. There is a step down in the diameter of the screw providing a shoulder 103 and from there the screw has a No. 10–24 thread at 104 up to the upper end, where a knurled nut 106 is received thereon and staked or otherwise affixed thereto. Prior to that, a knurled locknut 107 is received on the thread 104. This screw is slidably received in the small aperture at the top of the wedge bore 86.

The finger support plunger head 92 is urged against the wedge by a return spring 108 encircling the stem of the finger support plunger and abutting the wall 109 in the bracket and the underside of the head 92 of the plunger.

The gauging finger 111 is cylindrical and has a front end face 112 which is typically flat and smooth. Even if textured in some way, this face defines a workpiece stop plane at the end of the finger. The rear end of the finger proximate the finger support plunger, is slotted at 113A to provide a yoke between the two arm portions 113 of the finger. These portions are apertured and receive a pin 114 received in the apertured end 116 of the plunger 91. In the slot 113A between the arms 113, a flat rear face 117 is provided on the finger, parallel to the front face 112. Also, at the front end of the plunger 91, there is a flat face 118, above which a sloped face 119 is provided. The flat face 118 serves as an abutment for face 117 of the finger and thus it serves, rather than the pivot pin, to establish the distance between the locating face 112 of the finger and the locating face 63 of the gauge bar. Accordingly, the fingers can be pivoted freely enough to easily rise and fall as needed during operations on the workpiece, and yet reliability of gauging dimension is assured.

In the adjustment of the gauging fingers, which are shown in the rearward most position in the drawings, the locknut 107 is first unscrewed up against the underside of the knob 106. Then the knob 106 is turned with the thumb and forefinger to drive the wedge down. This drives the finger forward to the desired position with respect to the press brake dies. As that occurs, the shoulder 103 on the screw abuts the top of the wedge bore 86 and prevents the screw from rising, whereby the wedge is driven downward. When the desired adjustment has been achieved, the locknut is run down on the screw and tightened against the top of the bracket. To draw the wedge upward, the locknut is again released and the knob turned in the opposite direction. It can be pulled up by hand while turning, so the screw shoulder 103 remains against the upper end of the bore 86 to locate the plunger where desired. The return spring will keep the finger support plunger tightly engaged against the wedge plunger, and thereby retract the finger. Two or more finger assemblies on the gauge bar can be adjusted the same way to establish a workpiece stop plane which is vertical, and which is parallel to the press brake dies (the usual relationship) or skewed from the dies, if desired. Where large horizontal adjustments of gauge bar are desired, the T-groove mounts of the brackets 29, and the fast action handles 39 make it easy to do.

Where the two gauge bar support brackets are powered, with separate motors, they can be synchronized in the same or similar manner as described in the above mentioned U.S. Pat. No. 4,084,424. If desired, with suitable programming, the gauge bar and fingers can be raised or lowered for optimum height for the next bend, after each bend of the workpiece.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A workpiece locating finger assembly for gauging apparatus for presses and the like, and comprising:

a mounting bracket;

a workpiece abutment finger;

a finger mounting member having a base portion received on said bracket and having a connector portion adjacent said bracket;

said finger having a proximal portion pivotally connected to said connector portion;

adjustment means on said bracket and engaging said mounting member, said adjustment means including a wedge in stop relationship to said base portion of said mounting member;

and resilient means received on said bracket and urging said mounting member into engagement with said adjustment means.

2. A workpiece locating finger assembly for gauging apparatus for presses and the like, and comprising:

a mounting bracket;

a workpiece abutment finger;

a finger mounting member having a base portion received on said bracket and having a connector portion adjacent said bracket;

said finger having a proximal portion pivotally connected to said connector portion;

adjustment means on said bracket and engaging said mounting member;

and resilient means received on said bracket and urging said mounting member into engagement with said adjustment means;

said adjustment means including an adjusting screw, an adjusting screw receiving nut being threaded onto said screw and engaged to said bracket, said adjusting screw being threaded through said nut; and said adjustment means further including a wedge which engages said mounting member; and said adjusting screw being threaded into said wedge.

3. The assembly of claim 2 wherein:

said screw has a shoulder upwardly bearing on said bracket, and a manipulator at the top; and said nut is a locknut between the manipulator and the bracket.

4. A workpiece locating assembly for gauging apparatus for presses and the like, and comprising:

a mounting bracket;

a workpiece abutment;

adjustment means including wedge means in stop relationship to said abutment and operable to move said abutment relative to said bracket;

a finger mounting member having a head portion on said bracket and a connector portion, said finger having a proximal portion pivotally connected to said connector portion;

said wedge means engaging said mounting member and being in said stop relationship to said mounting member;

said finger having an abutment end normally defining a vertically disposed workpiece stop plane, said mounting member being fitted in said bracket for movement along a first axis perpendicular to said plane;

said wedge means being fitted in said bracket for movement along a second axis transverse to said first axis;

said second axis being generally parallel to said plane;

said second axis being vertical and perpendicular to said first axis;

said wedge means including a ramp;

said mounting member head portion engaging said ramp;

said head portion having a ramp matching and slidingly engaging said wedge means ramp;

said bracket having cylindrical bores therein;

said wedge means having a cylindrical body fittingly received and slidable in one of said bores;

said head portion being cylindrical and slidable in another of said bores;

said wedge means and base portion having interfitting keying means thereon at said ramps to maintain said ramps flush with each other.

5. The assembly of claim 4 and further comprising:

first spring seat means in said bracket, and second spring seat means on said head portion; and a spring compressed between said seat means and urging said head portion ramp against said wedge means ramp.

6. The assembly of claim 5 wherein:

said adjustment means include an adjusting screw exerting a force downward on said wedge means and upward on said bracket.

7. A workpiece locating gauge assembly for presses having tooling thereon, the gauge assembly comprising:

frame means mountable to a press and said frame means having elongate horizontally extending parallel guides thereon;

carriage means having bearing blocks thereon guidingly received on said guides whereby said carriage means are guided when driven horizontally toward and away from tooling on a press, each of said bearing blocks having a keyway therein extending parallel to the one of said guides on which the bearing block is guidingly received;

gauge mounting brackets having gauge bar receiving means thereon;

elevator means on said carriage means for raising and lowering said gauge mounting brackets and thereby raising and lowering said receiving means; and elevator means mounting brackets keyed to said carriage bearing block keyways.

8. The assembly of claim 7 wherein:

said keyways are T-slots, and said elevator means mounting brackets have handle operated T-nuts received in said slots for rapid clamping and release of said brackets relative to said bearing block keyways.

9. The assembly of claim 7 wherein said elevator means include:

vertical tubes vertically slidable in said elevator means mounting brackets and clamped thereto, said gauge mounting brackets being vertically slidable on said tubes;

nuts secured in said tubes;

drive screws mounted in said gauge mounting brackets and being axially confined relative to said gauge mounting brackets, said screws being threaded into said nuts and coaxial with said tubes.

10. The assembly of claim 9 and further comprising:

servomotors operatively coupled to said drive screws.

11. The assembly of claim 9 and further comprising:

an elongated gauge bar having a cross section substantially in the shape of a letter Y lying on its side, with upper and lower rear flanges clamped to said gauge bar mounting brackets.

12. The assembly of claim 11 wherein:

said gauge bar has an upturned front flange with a front gauging face, the assembly further comprising:

first and second gauge finger assemblies including bracket means mounted on said front flange and having forwardly projecting workpiece abutment fingers;

and adjustable wedge means associated with said fingers and serving as adjustable stops therefor.

13. The assembly of claim 12 wherein:

said gauge fingers are pivotably mounted to said bracket means and have horizontal pivot axes parallel to the front face of said gauge bar, and said fingers are pivotable upward about said axes.

14. The assembly of claim 13 wherein:

said gauge finger assemblies include finger support plungers slidable in said bracket means, and resiliently urged against said adjustable wedge means.

15. A gauge bar comprising:

an elongated member having a cross section resembling a letter Y lying on its side, and having an upturned flange at one side, a downturned flange at the lower arm of the Y on the other side, and an upturned flange at the upper arm of the Y on the other side.

16. The gauge bar of claim 15 wherein:

the upturned flange at the one side has a face parallel to faces of the upturned and downturned flanges at the other side.

17. The gauge bar of claim 16 wherein:

the face of the flange at the one side faces in the direction opposite the direction faced by said faces of the flanges at the other side, said faces of the flanges at the other side being co-planar.

18. The gauge bar of claim 17 wherein:

the vertical space between the co-planar flange faces is more than half the distance between the plane of the co-planar faces and the face on the one side.

* * * * *